United States Patent [19]

Paulucci

[11] 3,965,488

[45] June 29, 1976

[54] GOLF AID

[76] Inventor: Jeno F. Paulucci, 6 Minneapolis Ave., Duluth, Minn. 55806

[22] Filed: June 5, 1974

[21] Appl. No.: 476,428

[52] U.S. Cl. ..... 2/161 A; 273/183 B

[51] Int. Cl.[2] ..... A41D 19/00

[58] Field of Search ..... 273/183 B, 26 R, 26 C; 2/161 A, 159, 161 R; 40/2 R, 2 E, 129 R, 129 A; 35/29 A

[56] References Cited

UNITED STATES PATENTS

| | | | |
|---|---|---|---|
| 1,624,429 | 4/1927 | Palmer | 2/159 X |
| 3,214,852 | 11/1965 | Ford et al. | 40/129 A |
| 3,274,616 | 9/1966 | Russo | 2/161 A |
| 3,494,059 | 2/1970 | Minasian | 40/2 R |
| 3,508,280 | 4/1970 | Osborn | 2/159 |
| 3,588,917 | 6/1971 | Antonious | 2/161 A |

*Primary Examiner*—G. V. Larkin
*Attorney, Agent, or Firm*—Hume, Clement, Brinks, Willian, Olds & Cook, Ltd.

[57] ABSTRACT

A method of teaching and reminding a golfer of the basic fundamentals necessary to production of a good golf swing and, in addition, a golf glove construction. A series of phrases, each of which visually advises a golfer to perform one specific function fundamental to the golf swing, are arranged in a prescribed order on an adhesive strip of material elongated on one axis. The strip is fastened to the golf glove on the back of a golfer's upper hand with said axis extending back from the golfer's forefinger and generally intersecting the line of sight. The golfer views the instructions as he addresses the ball, swings to impact and follows through.

2 Claims, 2 Drawing Figures

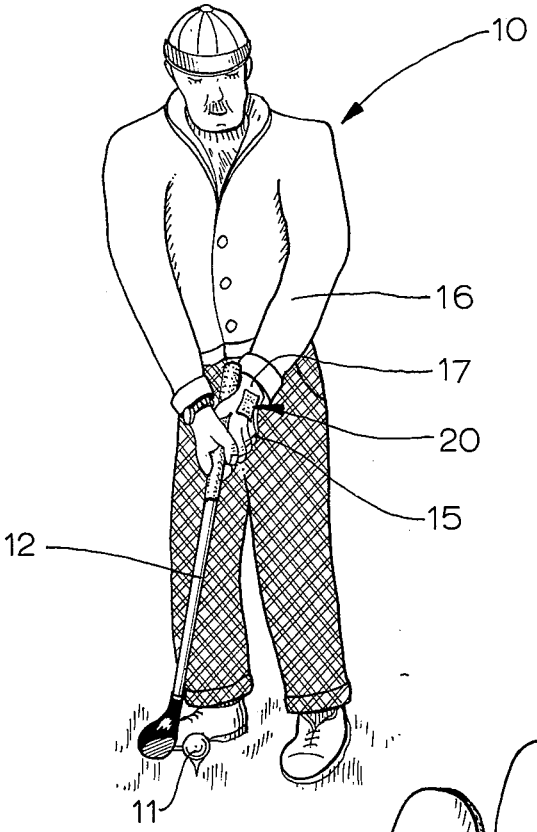
FIG. 1
FIG. 2
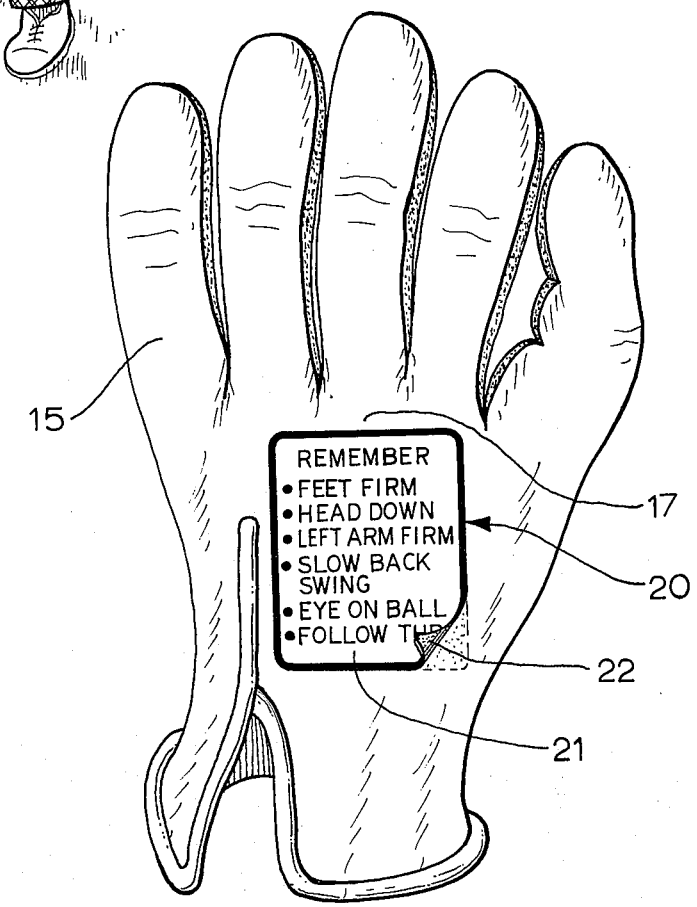

GOLF AID

FIELD OF THE INVENTION

This invention relates to the game of golf. More particularly, it is in the field of golf instruction.

BACKGROUND OF THE INVENTION

Golf has always been one of the more difficult "physical" games played by man. Hitting a small, white sphere, resting on the ground or on a tee, with the head of a golf club approximately 4 feet long is, in itself, a challenge. To do so in such a precise manner that the ball is struck in exactly the same way each time and that the maximum amount of force is obtained at impact with, nevertheless, precise directional control maintained might, if golf pros had not been seen to do it, be considered impossible.

Nevertheless, golf can be played very precisely if a student of the game rigidly follows a set of fundamentals for proper positioning and motion. These fundamentals form the basis for teaching a good golf stroke. As can well be imagined, however, not only teaching the fundamentals but making certain that the student or even accomplished golfer, consistently adheres to them each time he or she swings at the ball, is critical. Most golfers are fortunate if they concentrate on and execute a golf shot while correctly adhering to just two or three of the basic fundamentals of a good golf swing, much less than the six or so which together make for a good swing.

SUMMARY OF THE INVENTION

This invention is embodied in an improved method of teaching and reminding a golfer of the basic fundamentals necessary to production of a good golf swing. It is another object to provide such a method which is simple and inexpensive, yet achieves excellent results in golf shot production. It is still another object to provide a golf glove construction which provides a vehicle for the teaching method embodying features of the present invention.

The foregoing and other objects are realized in accord with the present invention by providing a method wherein six basic fundamentals of a good golf swing are each condensed to cryptic, two or three word phrases, and arranged on one side of a fabric patch having a pressure sensitive adhesive on the other side in vertically descending relationship according to their sequence of effectiveness and application in a golf swing. The fabric patch is removably fastened to the back of a golf glove, normally worn on the left hand of a right-handed golfer, for example. It is arranged on the golf glove so that when the golfer addresses the ball, the following fundamentals of golf appear before him, immediately below his line of sight to the ball:

Feet firm
Head down
Left arm firm
Slow back swing
Eye on ball
Follow thru

In a preferred embodiment, the fabric utilized is a white satin cloth tape. The adhesive utilized is any suitable but conventional pressure sensitive adhesive. The combination of satin tape and a pressure sensitive adhesive is effective to securely fix the tape to either a leather or a fabric golf glove.

BRIEF DESCRIPTION OF THE DRAWING

The invention, including its construction and method of operation, together with additional objects and advantages thereof, is illustrated more or less diagrammatically in the drawing, in which:

FIG. 1 is a perspective view of a righthanded golfer addressing a golf ball while being reminded of the basic fundamentals of a good golf shot, according to the method of the present invention; and FIG. 2 is an enlarged top plan view of a golf glove construction embodying features of the invention, including the pressure sensitive adhesive tape bearing fundamentals of a good golf shot on the back of the glove.

DESCRIPTION OF THE PREFERRED EMBODIMENT

Referring now to the drawing, and particularly to FIG. 1, a righthanded golfer is illustrated generally at 10. The golfer 10 is, as will be seen, positioned to address the golf ball 11 with a conventional "wood" golf club 12, in this case a driver since the golfer 10 is hitting from a golf tee.

As is common, the golfer 10 is wearing a golf glove 15 on his left hand 16. The left hand 16 is positioned on the handle of the club 12 so that the portion of the relatively flat back 17 of the glove immediately to the rear of the thumb and forefinger faces upwardly toward the golfer's eyes as he addresses the ball.

Referring now to FIG. 2 as well as to FIG. 1, according to the invention the back of the golfer's glove 17 has, affixed to it, a removable tape strip 20. The tape strip 20 is preferably made of white satin fabric in a rectangular shape, 2 inches in height by 1 ½ inches in width. The front surface 21 of the strip 20 carries indicia embodied in the method of the present invention. The back surface 22 of the strip 20 carries a suitable pressure sensitive adhesive of conventional composition.

The tape strip 20 is affixed to the back of the glove generally parallel to the axis of the index finger of the golfer, insofar as the long axis of the strip is concerned, so that when the club 12 is properly gripped, the tape is squared in front of the golfer's eyes. According to the invention, the tape strip 20 carries a sequence of fundamentals necessary to achieving a good golf shot. The illustrated strip 20, for example, carries the following fundamental abbreviations in this descending order:

REMEMBER:
Feet firm
Head down
Left arm firm
Slow back swing
Eye on ball
Follow thru As the golfer moves up to the ball and addresses it, he is advised to plant his feet firmly. Before beginning his back swing, his head will be down, eyes on the ball, looking directly over the strip 20. Prompted to maintain his left arm firm by what he sees on the tape strip 20, he also will bring the club back slowly. Finally, coming down into the ball and following through, his eyes will be on it. Result — a proper golf swing and, almost certainly, a good shot.

While several embodiments described herein are at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. A golf glove for the left hand of a righthanded golfer or the right hand of a lefthanded golfer, constructed wherein:

a. said glove has a relatively smooth back which, when the golfer grips the golf club properly and addresses the ball, includes a portion immediately to the rear of the golfer's thumb and forefinger facing upwardly toward the golfer's eyes, b. a strip of flexible material elongated on one axis, c. indicia in the form of instructive words or phrases provided on one side of said strip extending transversely of said axis so that they can be read easily and accurately only with the golfer's eyes looking along said axis from one end of said strip, and d. means on the other side of said strip for releasably fastening said strip to said back portion with said axis of said strip extending upwardly from and generally parallel to the golfer's index finger, e. said strip normally being fastened to said back portion with said one end of said strip being disposed away from the index finger and toward the golfer's eyes.

2. The golf glove construction of claim 1 further characterized in that:

a. said fastening means comprises a pressure sensitive adhesive.

* * * * *